United States Patent [19]

Wyman

[11] Patent Number: 5,026,241

[45] Date of Patent: Jun. 25, 1991

[54] APPARATUS AND METHOD FOR DUMPING A WASTE RECEPTACLE

[75] Inventor: Robert E. Wyman, Greenville, S.C.

[73] Assignee: Barker Products, Greenville, S.C.

[21] Appl. No.: 496,716

[22] Filed: Mar. 12, 1990

[51] Int. Cl.[5] ..... B65F 3/02

[52] U.S. Cl. ..... 414/303; 414/406; 414/421; 414/786

[58] Field of Search ..... 414/406, 408, 409, 303, 414/419-421, 425, 786

[56] References Cited

U.S. PATENT DOCUMENTS

| | | | |
|---|---|---|---|
| 3,738,516 | 6/1973 | Wells | 414/421 X |
| 3,804,277 | 4/1974 | Brown et al. | 414/421 X |
| 3,894,642 | 7/1975 | Shive | 414/421 X |
| 4,042,137 | 8/1977 | Hughes et al. | 414/409 X |
| 4,422,814 | 12/1983 | Borders | 414/421 X |
| 4,479,751 | 10/1984 | Wyman et al. | 414/406 |
| 4,580,940 | 4/1986 | Sheaves | 414/406 |

FOREIGN PATENT DOCUMENTS

| | | | |
|---|---|---|---|
| 1193418 | 5/1965 | Fed. Rep. of Germany | 414/406 |

*Primary Examiner*—David A. Bucci
*Attorney, Agent, or Firm*—Bailey & Hardaway

[57] ABSTRACT

An apparatus and method for lifting and dumping a waste receptacle attachable for use with refuse loaders and the like is illustrated as including a stationary frame A carrying a pivoted depending housing B supporting the waste receptacle provided with tracks C and cam rollers D for converting linear motion to rotary motion whereby the depending housing is pivoted for lifting and dumping the waste receptacle.

5 Claims, 5 Drawing Sheets

APPARATUS AND METHOD FOR DUMPING A WASTE RECEPTACLE

BACKGROUND OF THE INVENTION

This invention relates to an apparatus and method for automatically dumping waste receptacles wherein cam rollers and tracks are utilized for positively positioning the receptacles for rotary motion during dumping.

It is important that a lift unit apparatus for dumping waste receptacles be provided with a kick out feature to accommodate low ground clearance. Thus, the housing or carriage for supporting the waste receptacles should depend freely for pivotal movement from a position assumed due to gravity suspended from an upper pivot point so that in the event obstructions are encountered, the housing may pivot outwardly so as to avoid damage to the components of the lift unit apparatus. Apparatus having an automatic kick out feature is illustrated in U.S. Pat. No. 4,479,751. However, it is also important that such devices be constructed of simple rugged components capable of repeated abusive use during the process of garbage collection.

A rotary motion wherein cam rolls are carried in arcuate tracks is illustrated in U.S. Pat. No. 3,804,277 wherein a rotary actuator is utilized. However, the construction employing a rotary actuator is expensive and is relatively complicated.

Accordingly, it is an important object of this invention to provide a simple, inexpensive construction for use in lift unit apparatus for dumping waste receptacles and the like wherein a track and cam roller mechanism is operated by linear actuation.

A further object of the invention is the provision of an automatic kick out construction wherein the housing is freely pivotal to accommodate ground obstructions and which is engagable automatically for positively positioning the housing upon commencement of the lifting, dumping and return action of the lift unit apparatus.

Another important object of the invention is to utilize an eccentric linkage mechanism for automatically engaging a latching mechanism in order to positively position the waste receptacle during the lifting and dumping operation in combination with the cam roller mechanism described above.

SUMMARY OF THE INVENTION

It has been found that an improved simplified rugged construction may be provided for lift unit apparatus for dumping waste receptacles wherein cam rollers are carried in tracks and wherein linear actuating means are provided so that linear motion is converted to rotary motion to carry out the dumping operation. A kick out feature to avoid damage due to obstructions encountered during transport is provided by a track construction wherein the cam rollers are not confined within the track until lifting is commenced. Eccentric linkage mechanism is provided to automatically actuate a hook latching mechanism to positively position the waste receptacle during dumping.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate apparatus and method for lifting and dumping a waste receptacle attachable to refuse loaders, compactors and the like. A stationary frame A is attachable adjacent the loaders and compactors. A pivoted depending housing B supports the waste receptacle carried by the frame. A track C is carried by the housing. A cam roller D extends into the track. A linkage mechanism E which carries the cam roller D is pivotally carried by the frame, and a mechanism for producing linear motion F is pivotally mounted adjacent a lower end on the frame having connection to the linkage mechanism. Thus, linear motion is converted to rotary motion to raise the pivoted housing carrying the waste receptacle for rotation to dumping position. It is important to note that the cam roller is free of the track until engaged thereby during the lifting of the pivotal housing and for returning the mechanism after dumping to an initial position.

Figure 1:
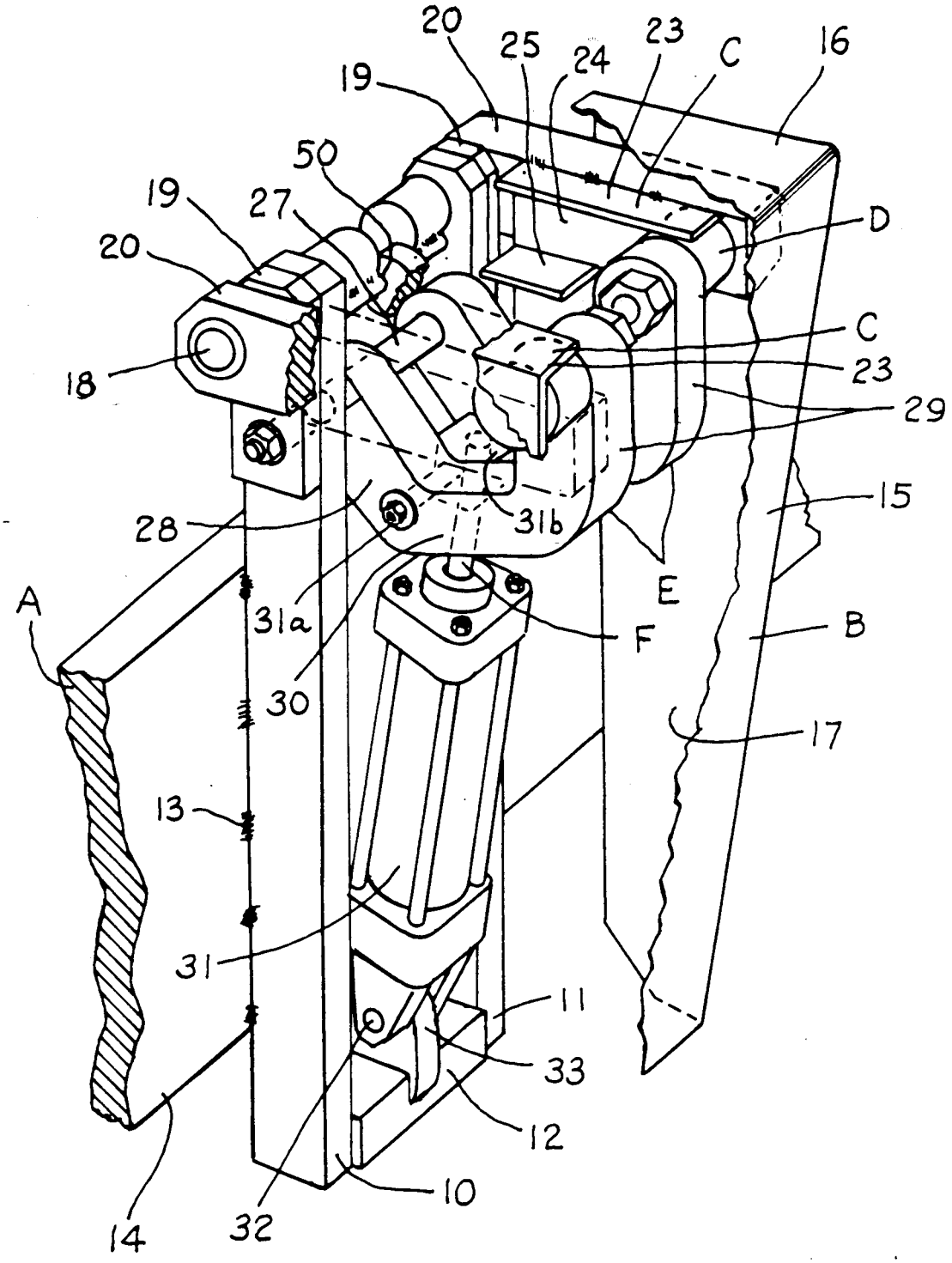
FIG. 1 is a perspective view illustrating an apparatus and method for dumping waste receptacles in accordance with the invention.

The stationary frame A is best illustrated in FIG. 1 as including vertical side frame members 10 and 11 which are joined at the bottom by a base 12. The stationary frame A is welded as at 13 to a rear frame member 14 of a dump truck. The apparatus hereof may be secured for dumping a waste receptacle in fixed relation adjacent a waste compactor or any other waste receiving device. A pivoted depending housing B includes a vertical plate 15 for supporting the refuse receptacle. The front plate, together with a horizontal upper member 16 and sides 17, forms a carriage or housing B which depends from the pivot formed by the shafts 18 carried in vertical blocks 19. A horizontal track C is carried by the housing in each upper corner. The tracks are carried on horizonal pivoted blocks 20 to which the pivoted depending housing B is secured as by screws 21. (FIGS. 2–5) The tracks C include an upper flange 23 which is joined by a web member 24 to a shortened lower flange member 25. A cam roller D is carried on linkage mechanism E and extends into the track C. The linkage mechanism is pivotally carried on the housing as at 27. The linkage mechanism E includes a pair of spaced aligned bell cranks each of which has a pair of diverging arms 28 and 29 at an acute angle being joined at the one end by an intermediate link 30.

A suitable mechanism for producing linear motion is provided in the form of an extensible member F which is carried by a cylinder 31. The cylinder 31 is pivoted at a lower end as at 32 upon a bracket 33 carried by the base member 12. The free end of the extensible member F is pivotally connected to each of the bell cranks at 31*a* through a shaft 31*b*.

The waste receptacle is indicated at 40 (FIG. 2) and includes an upper bar or handle 41 which is carried by the saddle 42 fixed to the depending housing B. A pivoted hook 43 engages a lower bar 45 carried by the waste receptacle or garbage can so as to firmly position same against the bracket 46.

Figure 2:
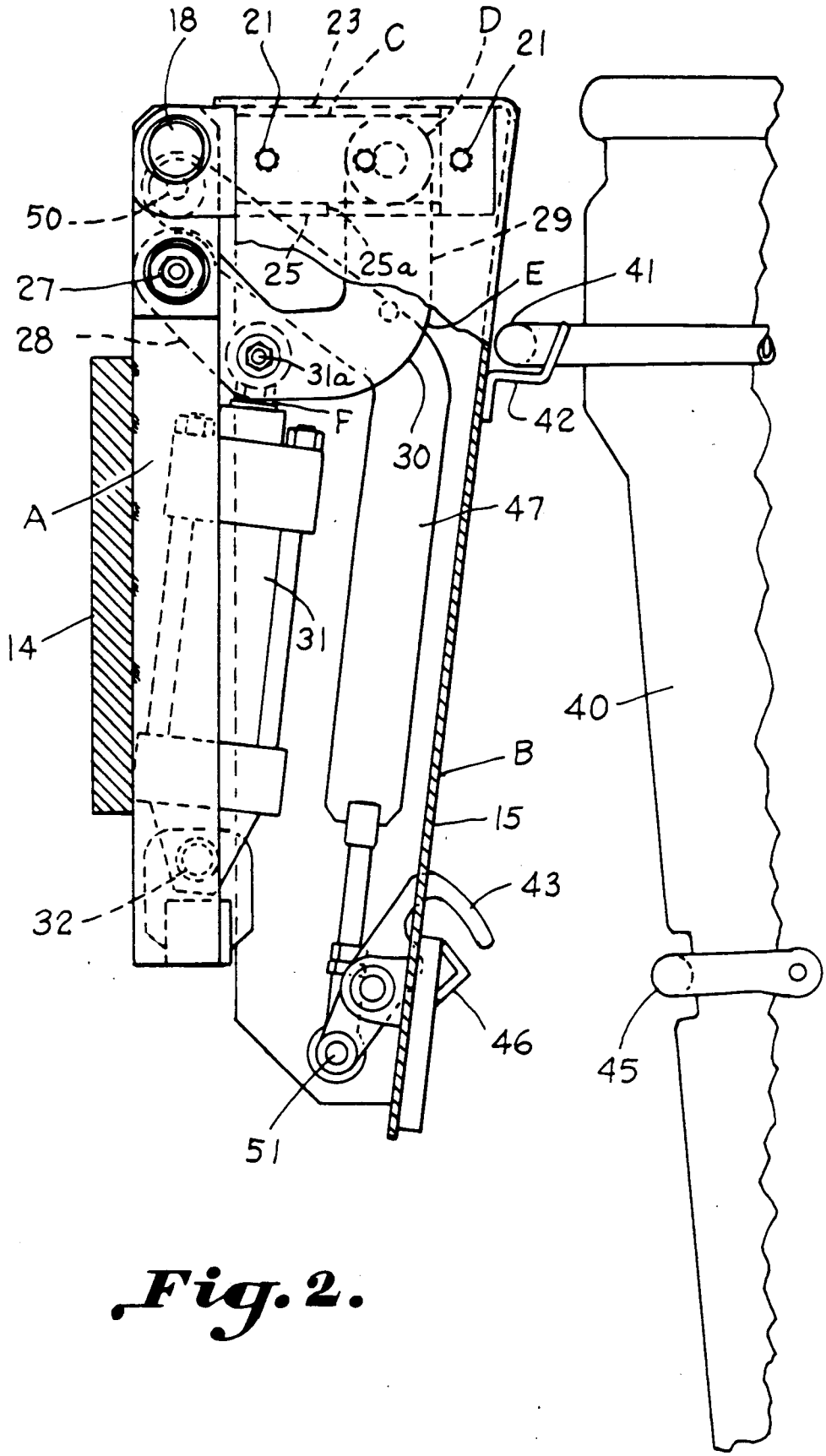
FIG. 2 is a schematic side elevation stage drawing illustrating the apparatus of FIG. 1 in down position receiving a waste receptacle preparatory to dumping.
Figure 4:
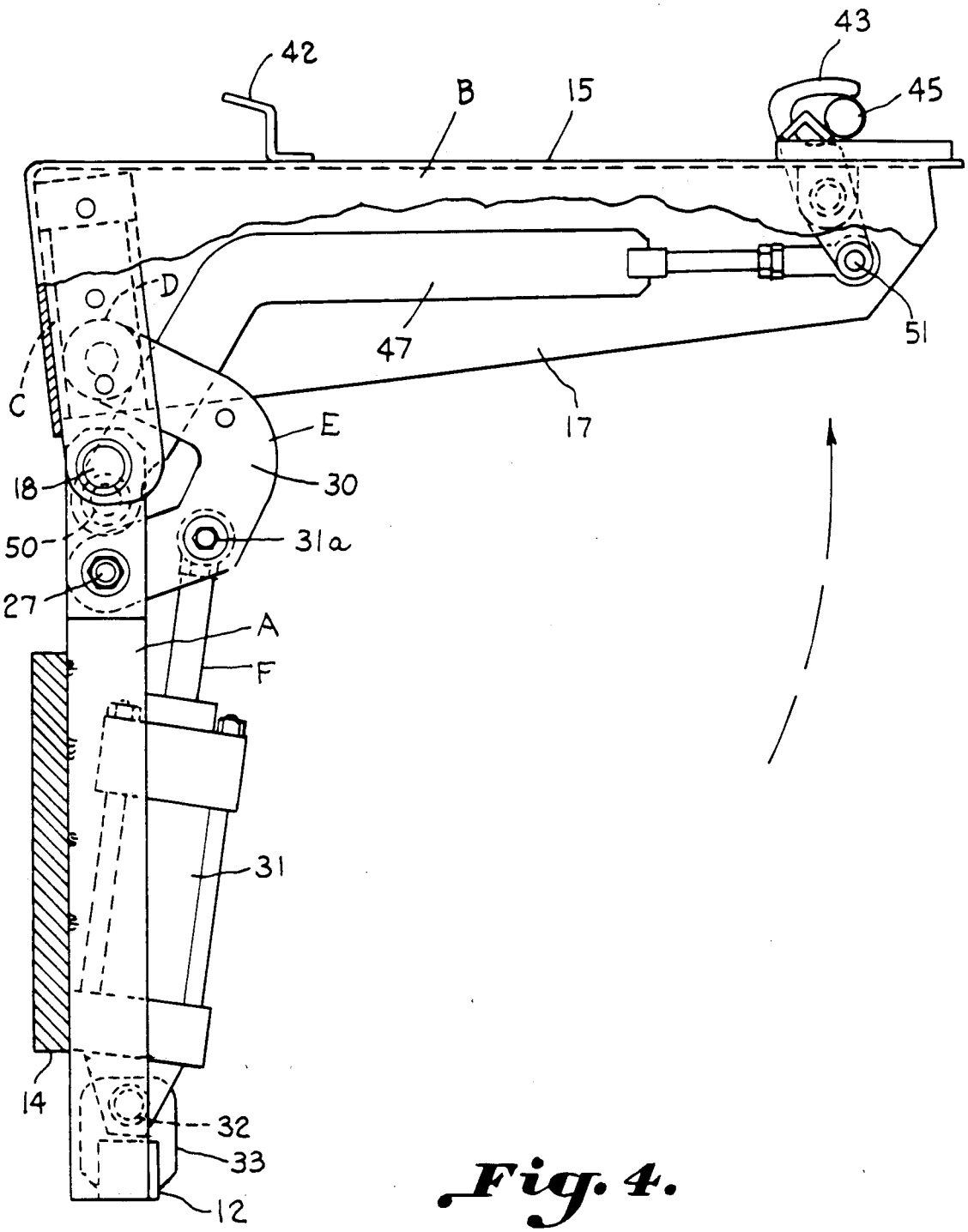
FIG. 4 is a side elevation illustrating the apparatus in further raised position.
Figure 5:
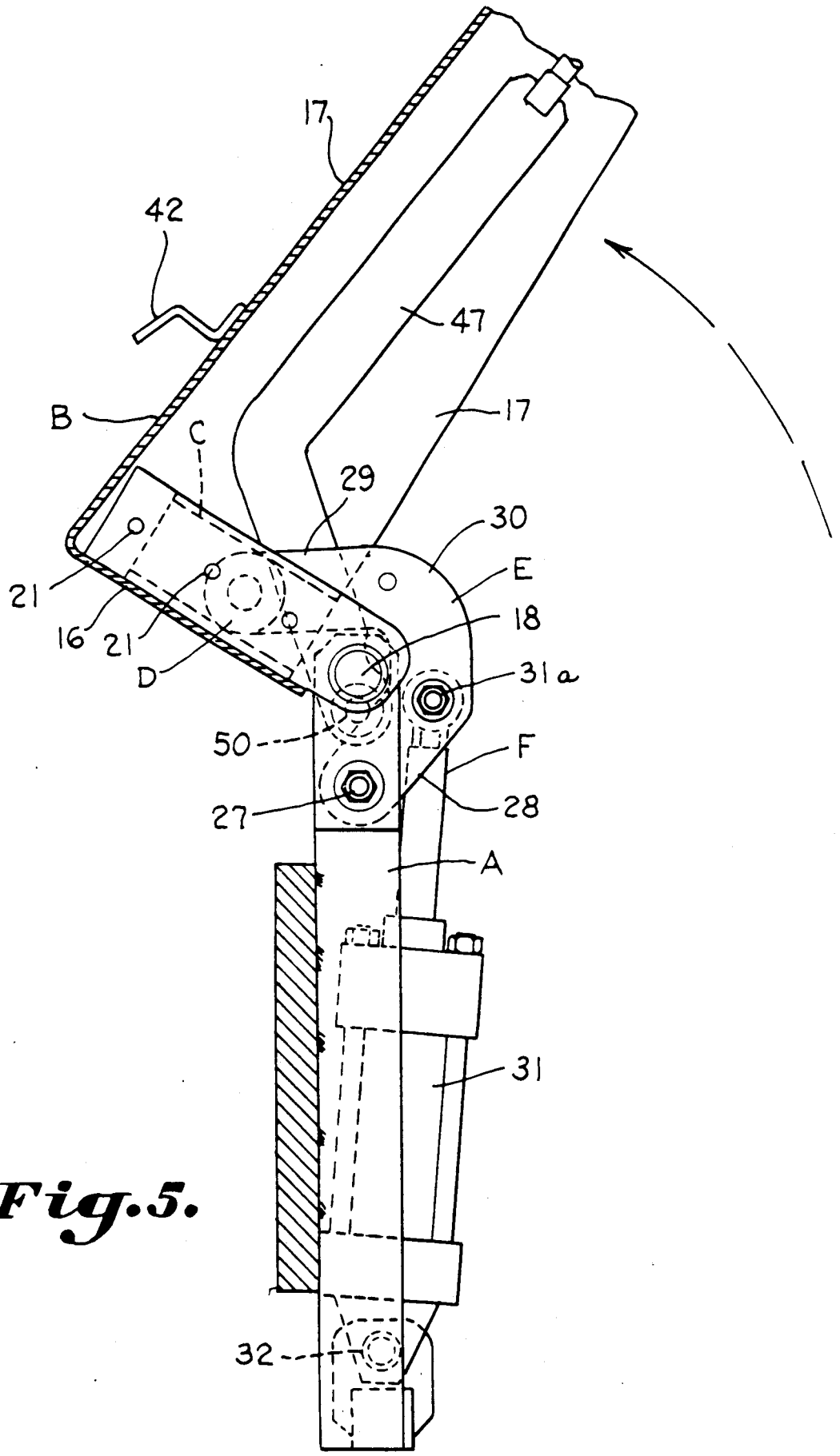
FIG. 5 is a side elevation illustrating an apparatus in up or dumping position.

For this purpose a linkage mechanism 47 is provided for pivoting the hook 43 downwardly in FIG. 2 so as to engage the bar 45 (FIG. 4). The linkage mechanism 47 is pivotally mounted on one end on a stub shaft 50 carried below the axis of the shafts 18 for movement between the bell cranks E. The linkage is pivotally connected on the other end at 51 to a free end of a link 52 which carries the hook 43 on an opposite end. The link 52 has pivotal connection with the housing B as at 53. When the housing B is raised during dumping, the linkage is shortened to pivot the latching member or hook downwardly into engagement with the bar 45.

Figure 3:
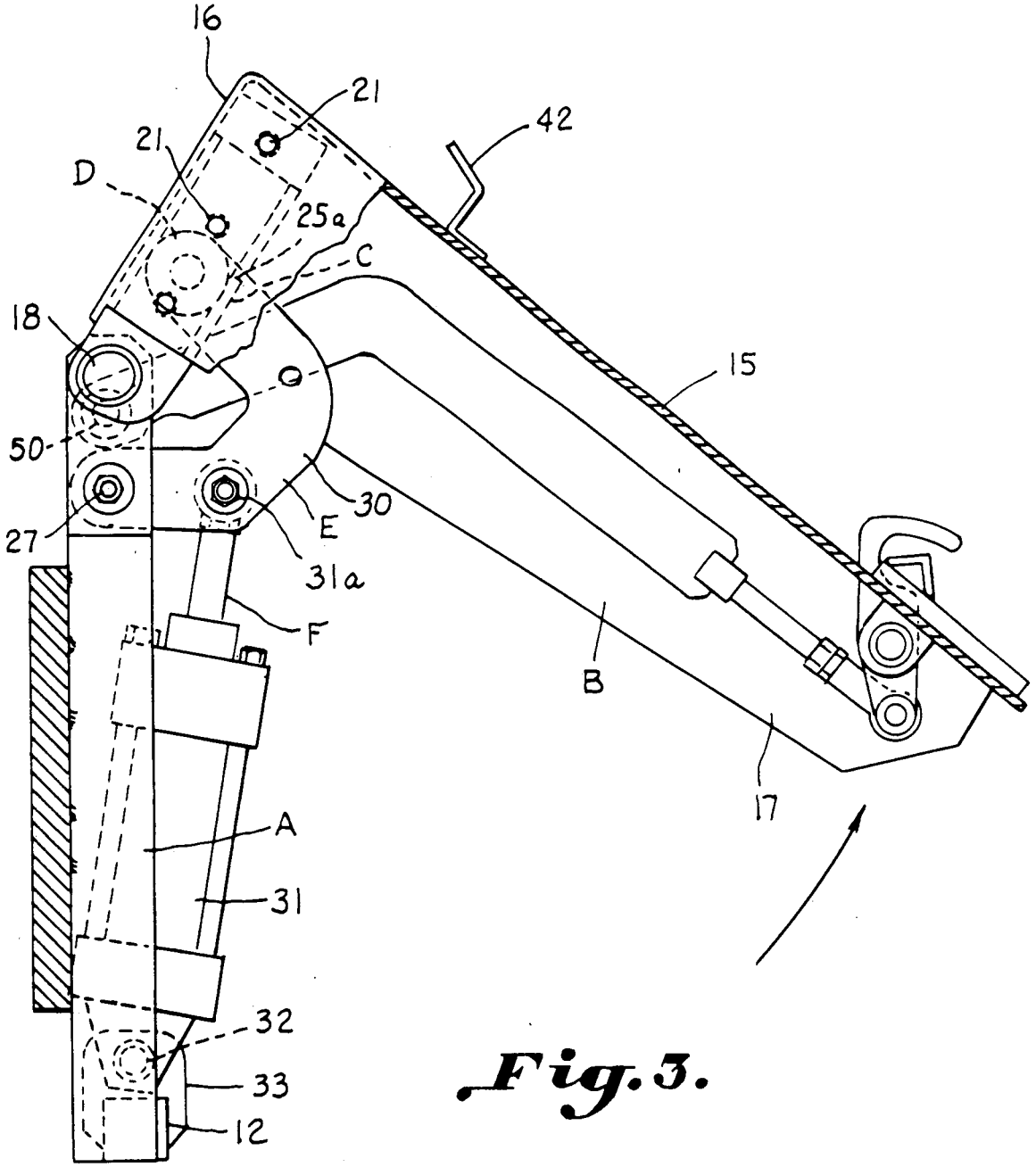
FIG. 3 is a side elevation illustrating the apparatus of FIG. 2 in a position wherein the positioning link is engaged upon the commencement of a lifting operation.

It is important to note that when the lifting mechanism is in down position as illustrated in FIG. 2 that the cam rollers D are free of the tracks C. This provides a free pivotal action when ground obstructions are encountered during transport. The end of the lower flanges are illustrated at 25*a*, and it will be noted in FIG. 2 that the cam rollers D have not passed same to become engaged or captured between the flanges forming the track members C. Upon the commencement of the lifting operation as illustrated in FIG. 3, it will be noted that the cam rollers D have become engaged by the tracks C having passed the end points 25*a*. This permits positive positioning of the refuse container during lifting for dumping and to lower the housing after dumping.

It is also important to note that the configuration of the bell cranks of the linkage mechanism E permits clearance of the same over the pivot mechanism connected to the frame during the lifting and dumping operation.

It is thus seen that a simplified device of rugged construction has been provided for enduring the abusive action which occurs during garbage collection with low maintenance requirements. Such apparatus is inexpensive and is readily adaptable to manufactured in volume.

While a preferred embodiment of the invention has been described using specific terms, such description is for illustrative purposes only, and it is to be understood that changes and variations may be made without departing from the spirit or scope of the following claims.

What is claimed is:

1. Apparatus for lifting and dumping a waste receptacle attachable for use on refuse loaders and compactors comprising:

a stationary frame attachable adjacent said loaders and compactors;

a pivoted depending housing supporting said waste receptacle carried by said stationary frame;

a track carried by said housing;

a cam roller extending into said track wherein said cam roller is free of said track until engaged thereby when raising said pivotal housing;

a linkage mechanism carrying the cam roller pivotally carried by said frame; and a mechanism for producing linear motion pivotally mounted adjacent a lower end on said frame having connection to said linkage mechanism;

whereby linear motion is converted to rotary motion to raise said pivoted housing carrying said waste receptacle for rotation to dumping position.

2. The structure set forth in claim 1 wherein said linkage mechanism includes a crank having a pair of diverging arms carrying said cam roller on a free end of one of said arms, said diverging arms joined at their respective opposite ends to an intermediate link.

3. The structure set forth in claim 1 wherein said linkage mechanism includes a crank having arms at an acute angle to each other and joined by an intermediate link, and wherein said mechanism for producing linear motion includes a fluid operated cylinder having an extensible member pivotally connected to said crank adjacent said intermediate link, a free end of one of said arms carrying said cam roller and a free end of the other of said arms having a pivotal connection to said frame beneath a pivot from which said housing depends.

4. The method of dumping a waste receptacle carried by a pivoted depending frame comprising the steps of:

providing a cam roller normally disengaged from a track so that said pivoted frame and a waste receptacle carried thereby is normally free to pivot upwardly to provide low ground clearance; and utilizing a linear actuating mechanism for imparting a rotary pivotal motion to said pivoted frame and for engaging said cam roller with said track for positively positioning said waste receptacle during dumping.

5. The method set forth in claim 4 including releasing said cam roller from said track automatically upon lowering said receptacle after dumping.

* * * * *